US005249890A

United States Patent [19]

Bergstrom

[11] Patent Number: 5,249,890

[45] **Date of Patent: * Oct. 5, 1993**

[54] MODULAR BACKPACK ASSEMBLY AND BUOYANCY COMPENSATOR

[75] Inventor: Neil R. Bergstrom, La Mesa, Calif.

[73] Assignee: Soniform, Inc., El Cajon, Calif.

[ * ] Notice: The portion of the term of this patent subsequent to Sep. 10, 2008 has been disclaimed.

[21] Appl. No.: 829,738

[22] Filed: Jan. 31, 1992

[51] Int. Cl.[5] ..... B63C 11/02

[52] U.S. Cl. ..... 405/186; 405/185; 441/114; 441/119

[58] Field of Search ..... 405/185, 186; 441/106, 441/114, 115, 116, 117, 118, 119

[56] References Cited

U.S. PATENT DOCUMENTS

| | | | |
|---|---|---|---|
| D. 299,286 | 1/1989 | Faulconer . | |
| 4,137,585 | 2/1979 | Wright . | |
| 4,608,940 | 9/1986 | Bulin . | |
| 4,694,772 | 9/1987 | Faulconer et al. | 405/185 X |
| 4,752,263 | 7/1988 | Pritchard . | |
| 4,778,307 | 10/1988 | Faulconer | 405/186 |
| 4,779,554 | 10/1988 | Courtney | 405/186 X |
| 4,810,134 | 3/1989 | Faulconer et al. | 405/185 X |
| 4,946,313 | 8/1990 | Augurelli | 405/186 |
| 4,952,095 | 8/1990 | Walters | 405/186 |
| 4,990,115 | 2/1991 | Vorhauer | 441/111 |
| 5,011,334 | 4/1991 | Vorhauer | 405/186 |
| 5,020,941 | 6/1991 | Bulin et al. | 405/186 |
| 5,046,894 | 9/1991 | Bergstrom | 405/186 |
| 5,074,714 | 12/1991 | Franco | 405/186 |

OTHER PUBLICATIONS

A catalog page for an Advert buoyancy compensator sold by Zeagle Systems, Inc.

A catalog page for Alpha and Beta buoyancy compensators sold by Zeable Systems, Inc.

Pages from Zeagles 1991 catalog.

Pages from Zeagles 1992 catalog.

A catalog page for a Sea Horse buoyancy compensator sold by Seatec.

*Primary Examiner*—David H. Corbin

*Assistant Examiner*—Arlen L. Olsen

[57] ABSTRACT

A buoyancy compensator includes a backpack assembly for holding a tank of compressed gas and an inflatable air cell which is removably attached to the backpack assembly. The backpack assembly includes a cummerbund and a shoulder harness so that the backpack assembly can be used to support a tank with or without the air cell. The cummerbund and shoulder harness support the entire weight of the tank, and the air cell is not required to support any of the load of the tank. The air cell is shaped to provide flotation in the lower back to buttocks area of the wearer and in the rib cage area.

12 Claims, 6 Drawing Sheets

Fig. 13
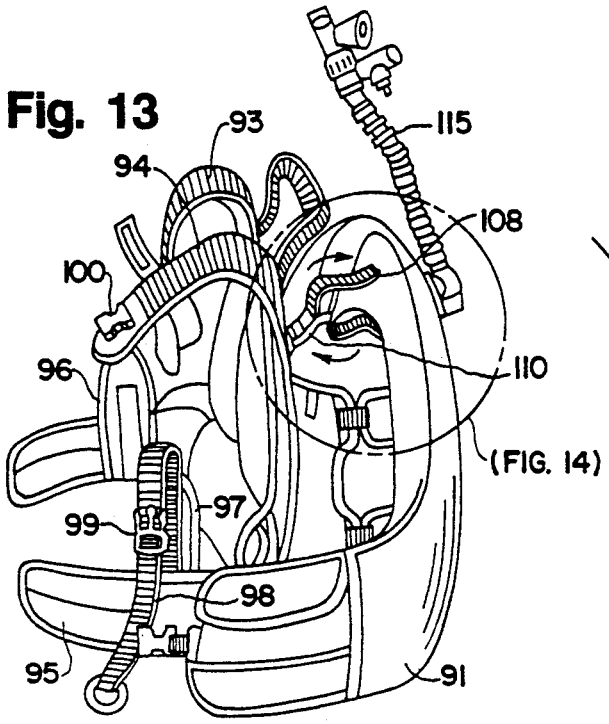
Fig. 14
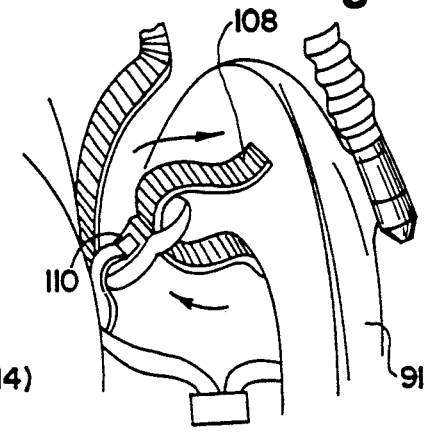
Fig. 16
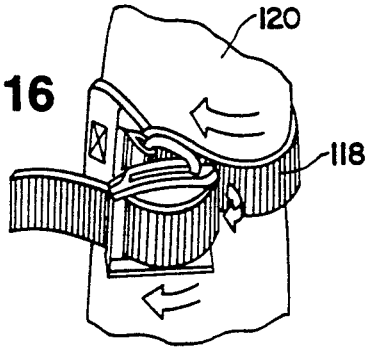
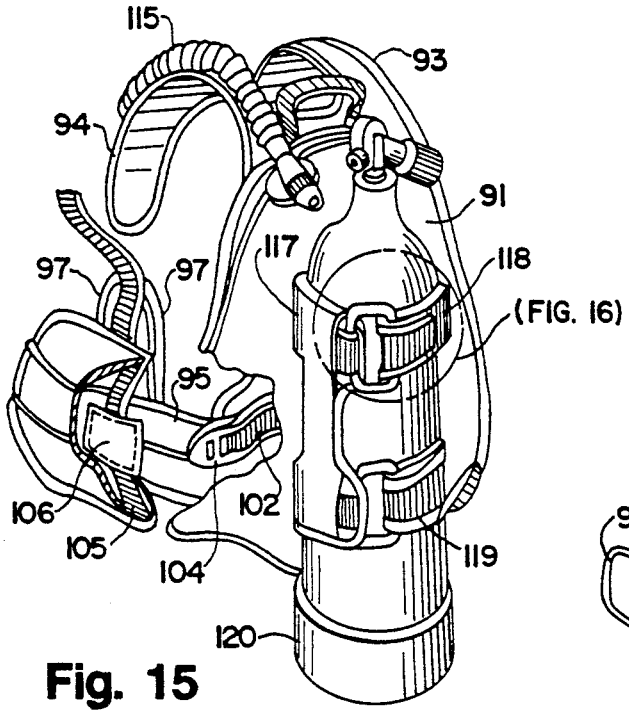
Fig. 15
Fig. 17
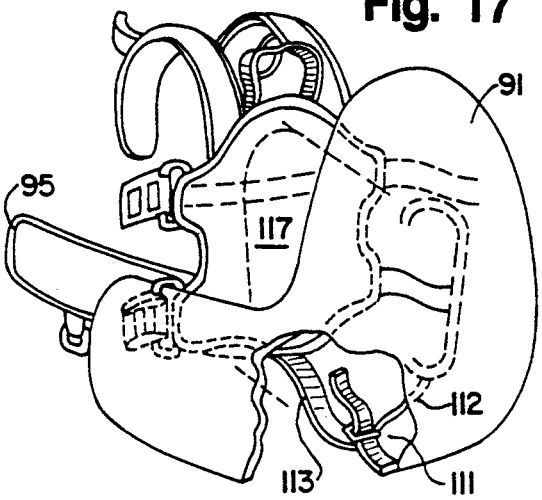

MODULAR BACKPACK ASSEMBLY AND BUOYANCY COMPENSATOR

BACKGROUND

This invention relates to backpack assemblies of the type which are used by scuba divers to support a tank of breathing air. More particularly, the invention relates to a modular buoyancy compensator which includes a backpack assembly having its own harness system for attaching the backpack assembly to a diver and a separate inflatable air cell which can be releasably attached to the backpack for providing buoyancy compensation.

U.S. Pat. No. 5,046,894 describes a buoyancy compensator with interchangeable backpacks which can be removably attached to the buoyancy compensator. Buoyancy compensation is provided by a vest with an inflatable air cell inside the vest, and the vest includes shoulder straps for supporting a portion of the weight of the tank. The backpack cannot function as a stand-alone unit and has to be attached to the vest before the backpack can be used by a diver.

U.S. Pat. No. 4,990,115 describes a similar buoyancy compensator in which the harness system which supports the weight of the tank is an integral part of the inflatable air cell. In both the '894 and '115 patents the functions of tank support and buoyancy are not separated, and the air cell is required to support some of the load of the tank.

U.S. Pat. No. 4,752,263 describes a component system which contains an air cell, a backpack, and a weight drop system which assemble to each other. The backpack does not include a truss structure to distribute the load of the tank efficiently, and the backpack is constructed of a rigid, permanent material other than fabric. Further, the air cell does not define a specific control of buoyancy, either in the location of the buoyancy or the lift capacities. The backpack and air cell are custom designed and are not intended to be used with other backpacks or air cells.

U.S. Pat. No. 4,608,940 also describes a component system which includes an air cell, a backpack, and a weight drop system. The backpack is constructed of fabric and contains a waist closure and shoulder extensions which attach to the waist closure. However, the backpack does not provide the construction or function of a truss support system of harness and does not distribute the weight of the tank to the hips and shoulders of the diver.

U.S. Pat. No. 299,286 describes an "alpine pack system" which contains a rigid back subassembly which is attached to a neoprene shoulder harness subassembly to form a tank support system. The pack does not include shoulder extensions or a waist closure. The shoulders are provided by a fabric subassembly that stretches over and attaches to the rigid back form, and the pack uses a standard cummerbund configuration which does not contain a truss support system. The entire system must be assembled with an air cell in order to be functional.

U.S. Pat. No. 4,137,585 describes a buoyancy compensator which includes some of the features of the other patents.

SUMMARY OF THE INVENTION

The modular buoyancy system of the invention separates the two main functions of tank support and variable buoyancy control. The system thereby enables more efficient manipulation by the diver up to and including the ability to add various incremental lift capacities in direct compensation for the negative lift created by lead weight belts as dictated by the individual diver's ballast requirements.

The system comprises two unique subsystems which interchangeably fasten to each other through strap and buckle connections. The first subsystem is an independent backpack or harness assembly which is intended to carry either a single tank or a double tank for scuba diving applications. The harness includes a cummerbund and shoulder straps, and two auxiliary support panels are positioned on the cummerbund to form a truss support which distributes and carries the load of the tank throughout the hips and shoulder areas of the diver.

The second subsystem is an air cell which is releasably attached to the harness system. The air cell does not include shoulder extensions, and the air cell is configured to distribute some of the buoyancy away from the shoulders and side lobes and into the lower central portion of the air cell, thereby locating flotation in two areas—the lower back-to-buttocks area and the rib cage area. The air cell places more buoyancy below the water line, producing more effective lift for the diver.

When the two subsystems are combined, they produce a total buoyancy compensation system which delivers more effective buoyancy with lower air cell capacities, a vest system which produces no vest squeeze when the air cell is fully inflated, a harness which delivers superior control and support of the tank, and a friendlier vest to don and doff. The modularity feature also allows the diver to attach different lift capacities, to interchange hard and soft harness assemblies, and to use the harness alone without the air cell.

DESCRIPTION OF THE DRAWING

The invention will be explained in conjunction with illustrative embodiments shown in the accompanying drawing, in which

FIG. 13 is a perspective view of the assembled backpack assembly and air cell;

FIG. 14 is an enlarged view showing the upper attachment between the air cell and the backpack;

FIG. 15 is a rear perspective view, partially broken away, of the backpack and air cell;

FIG. 16 is an enlarged view of the tank strap;

FIG. 17 illustrates the lower attachment between the air cell and the backpack.

DESCRIPTION OF SPECIFIC EMBODIMENTS

Figure 1:
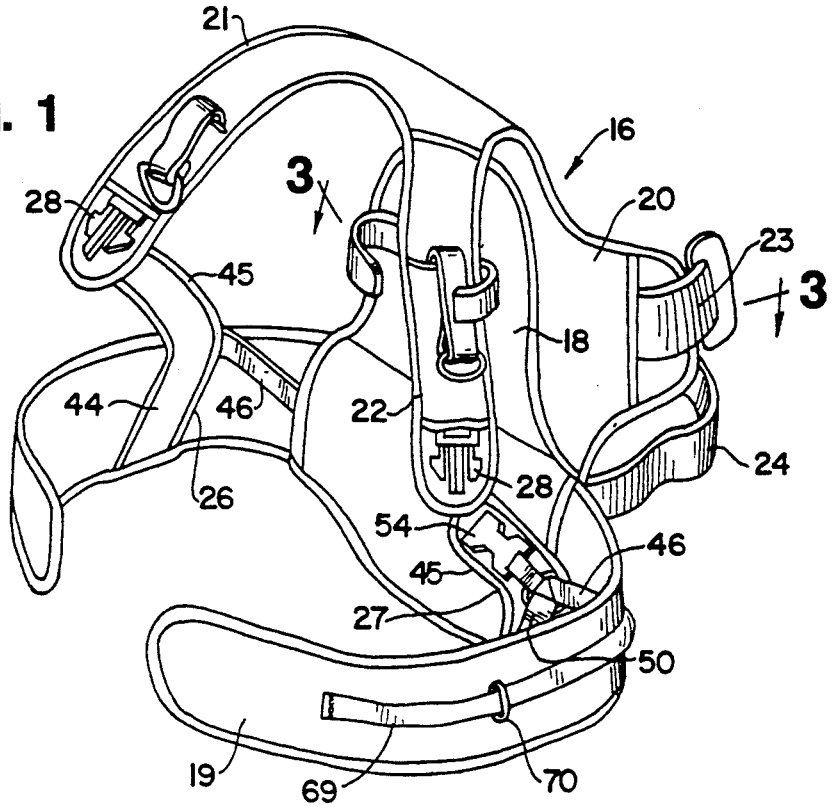
FIG. 1 is a perspective view of a backpack assembly formed in accordance with the invention.
Figure 2:
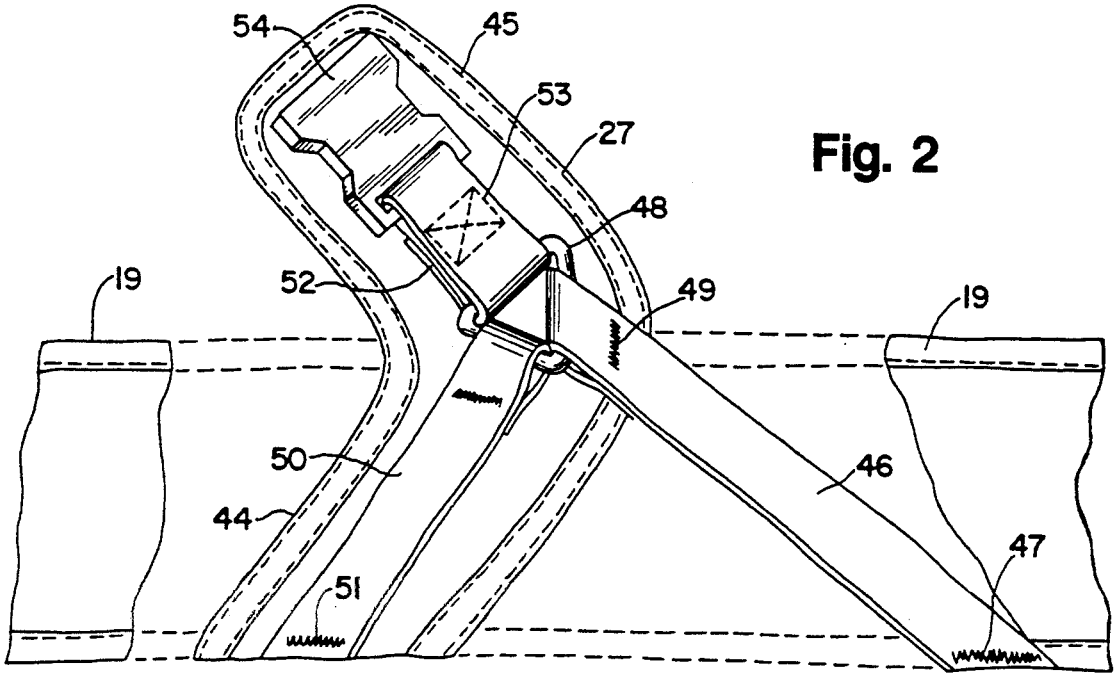
FIG. 2 is a fragmentary elevational view of one of the auxiliary support panels on the cummerbund of the backpack assembly of FIG. 1.
Figure 7:
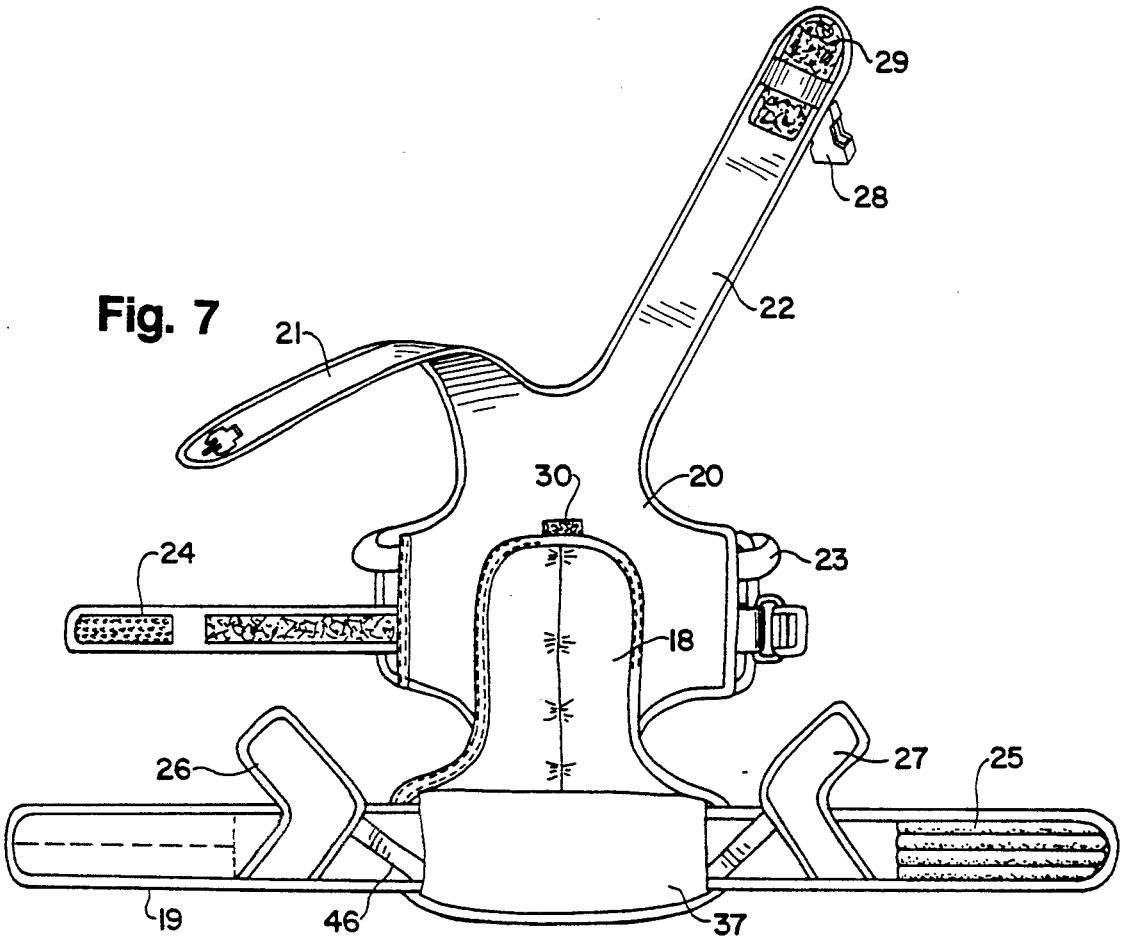
FIG. 7 is an exploded view of the backpack assembly showing the separate back panel and tank support panel.

Referring first to FIG. 1, a backpack assembly or harness assembly 16 includes a back panel 18, a cummerbund 19 which is attached to the back panel, and tank support panel 20 which is attached to the rear surface of the back panel 18 (see also FIG. 7). The tank support panel 20 extends upwardly to form a shoulder harness which includes shoulder straps 21 and 22. Tank straps 23 and 24 are attached to the tank support panel for securing a conventional tank of compressed breathing gas such as air or oxygen. The exterior surfaces of the various components of the backpack are preferably formed from nylon fabric which is stitched together.

The cummerbund is adapted to encircle the waist of a diver, and the ends of the cummerbund are equipped with suitable fastening means such as hook and loop fasteners 25 (FIG. 7) which are sold under the trademark Velcro. The shoulder straps 21 and 22 extend over the shoulders of the diver and are attachable to auxiliary support panels 26 and 27 which are attached to the cummerbund and extend upwardly therefrom. Suitable fasteners such as conventional quick release buckles 28 are mounted on the shoulder straps 21 and 22 and auxiliary panels 26 and 27 for connecting the straps and panels. If desired, Velcro fastener tabs 29 (FIG. 7) or straps and D-rings can also be used.

The backpack assembly 16 is the type which is commonly referred to as a soft pack. The tank support panel 20 is flexible and confirms to the shape of the air tank when the tank is secured by the straps 23 and 24. The bottom portion of the tank support panel 20 is permanently secured to the bottom portion of the back panel 18 by stitching, and the upper portions of the two panels are releasably attached by hook and loop fasteners 30 (FIG. 7). The hook and loop fasteners enable the tank support panel 20 to freely form around the tank without distorting the free form of the upper region of the back panel 18.

Figure 3:
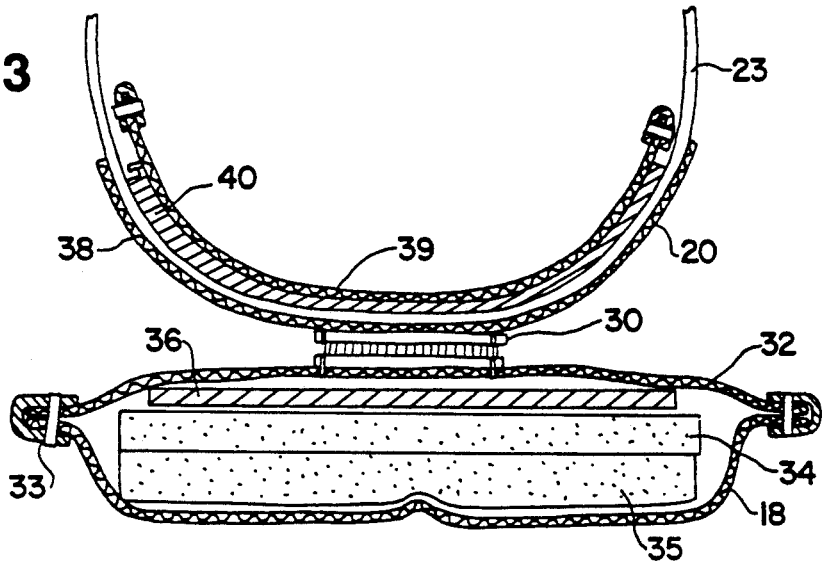
FIG. 3 is a sectional view taken along the line 3—3 of FIG. 1.

Referring to FIG. 3, the back panel 18 includes a fabric shell 32 which is formed from two sheets of fabric which are secured by stitching 33, and the shell encloses two or more compressible and resilient cushioning pads 34 and 35 and a relatively incompressible but flexible panel 36 to protect the center or spinal area of the diver's back from the tank. A lumbar pad 37 (FIG. 7) is secured to the back panel 18 in front of the cummerbund 19 to provide additional padding to the lumbar region of the back. The tank support panel 20 includes a fabric sheet 38 and a sheet 39 of rubberized fabric which are stitched together and enclose a rigid plastic panel 40 which is curved to conform to the shape of the tank. The straps 23 and 24 are also stitched in place between the sheets 38 and 39.

Each of the auxiliary support panels 26 and 27 is generally V-shaped and include a lower portion 44 which is stitched to the cummerbund 19 and which is angled upwardly and rearwardly and an upper portion 45 which extends upwardly and forwardly from the cummerbund. A main support strap or ligament 46 is aligned with the upper portion 45 of the support panel, and the bottom of the strap 46 is secured to the bottom edge of the cummerbund 19 by stitching 47. The upper end of the strap 46 is looped about a triangularly shaped ring 48 and is secured by stitching 49 to form a loop. A secondary support strap or ligament 50 is aligned with the lower portion 44 of the auxiliary support panel and is secured to the bottom of the cummerbund by stitching 51. The upper end of the auxiliary strap 50 is attached to a second leg of the triangularly shaped ring 48. The ring 48 is attached to the upper portion 45 of the auxiliary support panel by a strap 52 which is secured by stitching 53. The strap 52 also is attached to a quick-release buckle 54 which mates with the buckle 28 (FIG. 1) on the shoulder strap 22.

The V-shaped auxiliary support panels 26 and 27 are positioned on the cummerbund so that they will be on the sides of the diver. The forwardly angled upper portions 45 can be attached to the shoulder straps without passing directly over the front of the diver, and the backpack can be worn comfortably by both male and female divers without having the harness system pass over a female diver's breasts.

The backpack system provides a true backpacking styled, truss support system for the scuba tank which distributes the weight of the tank to the hips and shoulders of the diver. The weight support creates less fatigue for the diver on land while giving superior control and stability under water. If desired, the cummerbund 19 can include an elastic portion as described in U.S. Pat. No. 4,990,115 so that the cummerbund can expand and contract as the diver changes depth.

Figure 4:
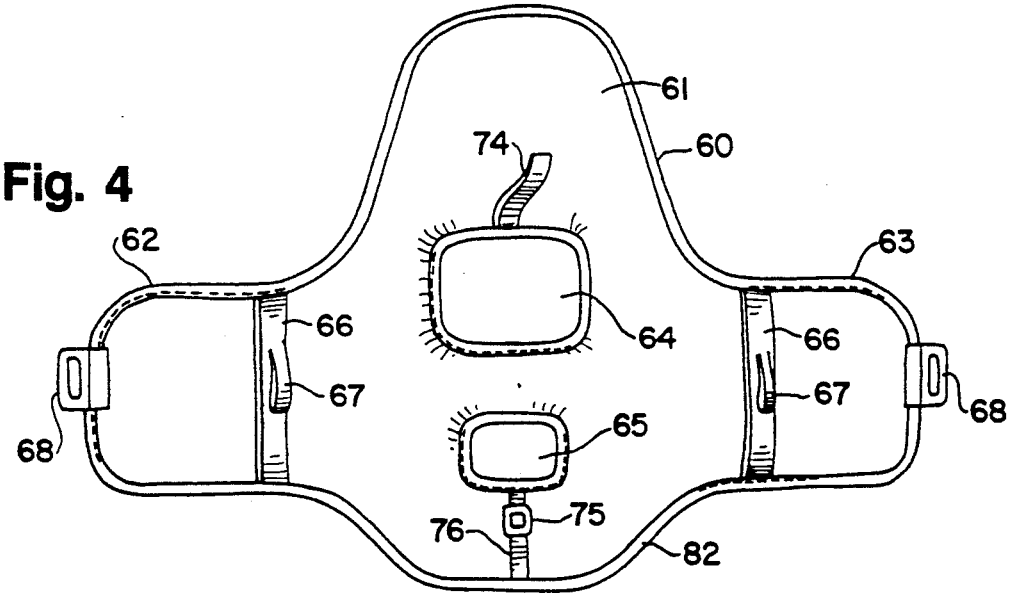
FIG. 4 is a plan view of an inflatable air cell for use with the backpack assembly.

Referring to FIG. 4, an inflable air cell 60 is formed from two nylon fabric sheets which are stitched together around the edges. The fabric sheets enclose a conventional air bladder which can either be provided separately or can be formed by an air-impermeable layer on the inside of the fabric. The air cell includes a back portion 61 and a pair of side lobes 62 and 63 which are adapted to extend along the sides of the waist of the diver. The back portion is provided with a pair of central openings 64 and 65. The air cell is equipped with a conventional inflator tube (not shown) which is well known in the art for inflating and deflating the air cell.

The backpack assembly 16 can be used with or without the air cell 60. If a diver wishes to use an air tank without buoyancy compensation, the backpack assembly can be used without the air cell. If buoyancy compensation is desired, the backpack assembly is attached to the air cell by inserting the flexible tank support panel 20 and the tank strap 23 through the large central opening 64 in the air cell and inserting the strap 24 through the opening 65.

Figure 6:
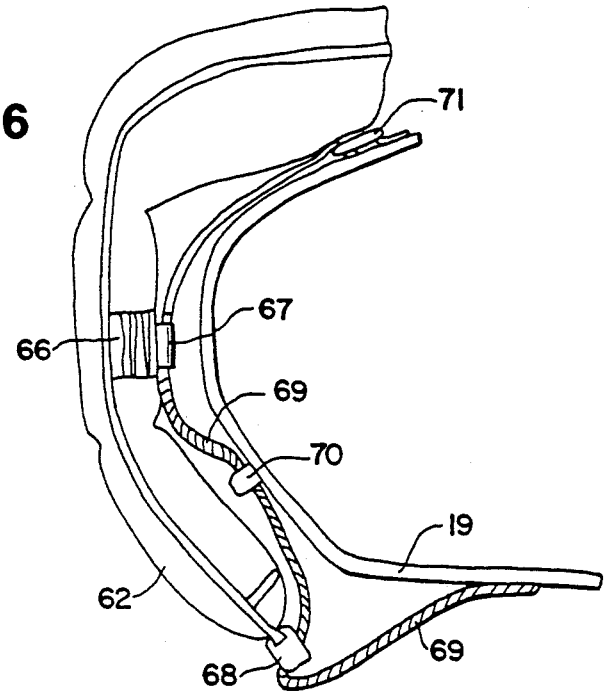
FIG. 6 is a fragmentary top plan view showing the attachment between one of the lobes of the air cell and the cummerbund of the backpack assembly.

A fabric strap 66 is attached to each of the side lobes, and each strap includes a loop 67. A plastic loop 68 is attached to the end of each side lobe. A fabric strap 69 (FIG. 1) is attached to each end of the cummerbund and is adapted to extend through a plastic loop 70 on the cummerbund and a buckle 71 on the back of the cummerbund. Each end of the cummerbund is attached to one of the side lobes of the air cell by passing the strap 69 on the cummerbund through the loops 68, 70, and 67 and tightening the strap by means of the buckle 71 (see FIG. 6).

A fabric strap 74 (FIG. 4) is attached to the air cell above the opening 64 and is threaded through a buckle on the tank support panel 20 of the backpack. A buckle 75 is attached to the bottom of the air cell by a strap 76, and a strap on the bottom of the tank support panel 20 is threaded through the buckle 75.

Figure 5:
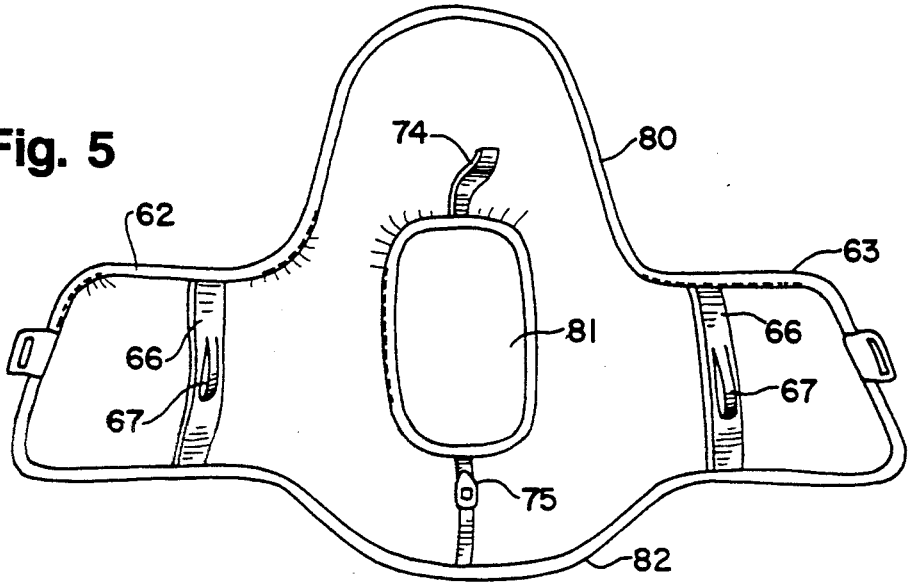
FIG. 5 is a plan view of another embodiment of an inflatable air cell.

A modified air cell 80 is illustrated in FIG. 5. The air cell 80 is substantially the same as air cell 60 except that a single, large central opening 81 is provided in the back of the air cell.

When the backpack assembly 16 is attached to the air cell 60, the tank support panel 20 and the tank straps 23 and 24 extend through the openings 64 and 65 in the air cell. The air tank can then be secured against the non-skid, rubberized fabric sheet 39 by the straps 23 and 24.

Each of the air cells 60 and 80 deemphasizes the amount of flotation in the upper back area and includes a lower back portion 82 which extends below the side lobes 62 and 63. The air cell thereby provides substantial flotation in the lower back-to-buttock areas and the rib cage area of the diver and places more buoyancy below the water line, thereby producing more effective lift for the diver. The air cells can be utilized with lower capacity which delivers equal or greater lift than traditional shapes of air cells while providing effective control for the diver below the surface of the water.

It will be understood that many other shapes of air cells can be used which will provide the desired flotation. Also other means for attaching the air cell to the backpack can be used.

FIGS. 8–17 illustrate a modified backpack assembly 90 and air cell 91. The backpack includes a back panel 92 which includes shoulder straps 93 and 94. A cummberbund 95 is attached to the back panel, and auxiliary support panels 96 and 97 are attached to the cummerbund. A strap 98 is attached to each of the auxiliary support panels, and a quick-release buckle 99 on the strap can be connected to a quick-release buckle 100 on one of the shoulder straps. The ends of the cummerbund can be releasably attached by Velcro fastener pads.

The air cell 91 is similar to the air cell 80 of FIG. 5 but utilizes a different attachment system. A fabric strap 102 is secured to each of the side lobes of the air cell by stitching 103 and can be threaded through a buckle 104 (FIG. 10) which is attached to the back panel 92. A strap 105 attached to the top of each lobe can be threaded downwardly through a fabric sleeve 106 (FIG. 11) on the back panel and through a buckle 107 (FIG. 12) which is attached to the bottom of the lobe.

A top strap 108 is attached to the air cell above the central opening 109 and is attached to a buckle 110 (FIG. 13) on the back panel. A buckle 111 on a strap 112 is attached to a strap 113 (FIG. 17) on the bottom of the back panel. A quick release buckle 114 is attached to the end of strap 102 and can be connected to a mating buckle on the other lobe of the air cell.

The air cell is inflated by a conventional inflator tube 115.

A tank support panel 117 is attached to the back of the back panel 92 of the backpack. A pair of tank strap assemblies 118 and 119 are mounted on the tank support panel, and the tank support panel and the tank straps are inserted through the opening 109 in the air cell when the air cell is attached to the backpack. An air tank 120 is secured to the backpack by the strap assemblies 118 and 119 in the conventional as illustrated in FIG. 16.

Figure 18:
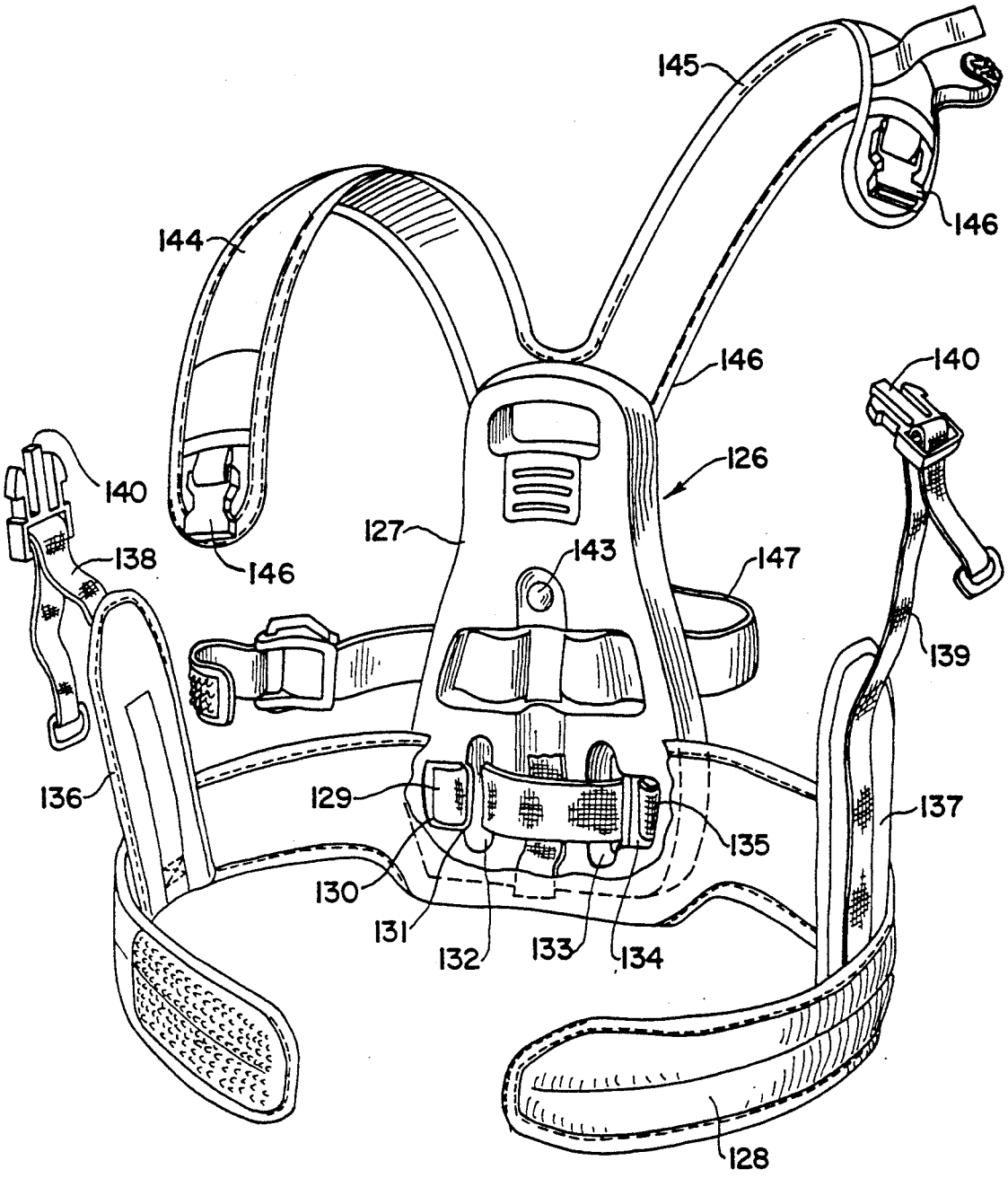
FIG. 18 is a perspective view of a hard backpack assembly.

FIG. 18 illustrates a hard backpack assembly 126. The backpack assembly 126 includes a hard backpack frame 127 of the type which is described in U.S. Pat. No. 5,046,894. A cummerbund 128 extends in front of the backpack frame 127 and is attached to the backpack frame in the manner described in U.S. Pat. No. 5,046,894. A portion of the cummerbund which extends in front of the backpack frame is broken away to illustrate the attachment mechanism. A strap 129 which is attached to the cummerbund is threaded through slots 130 through 135 in the frame, and the free end of the strap 129 is secured to the cummerbund by Velcro fasteners. Auxiliary support panels 136 and 137 are attached to the cummerbund and extend upwardly from the cummerbund. Straps 138 and 139 are attached to the auxiliary support panels, and quick release buckles 140 are attached to the straps.

A harness panel 142 is secured to the back of the backpack frame 127 by the conventional curved backing plate which is attached to the frame by bolt 143 and against which the air tank is clamped. The harness panel includes shoulder straps 144 and 145 which are equipped with quick release buckles 146 which can be connected to the buckles 140 on the auxiliary support panels 136 and 137. A tank strap 147 is threaded through slots in the backpack frame 127 for securing the air tank against the backpack frame.

Figure 8:
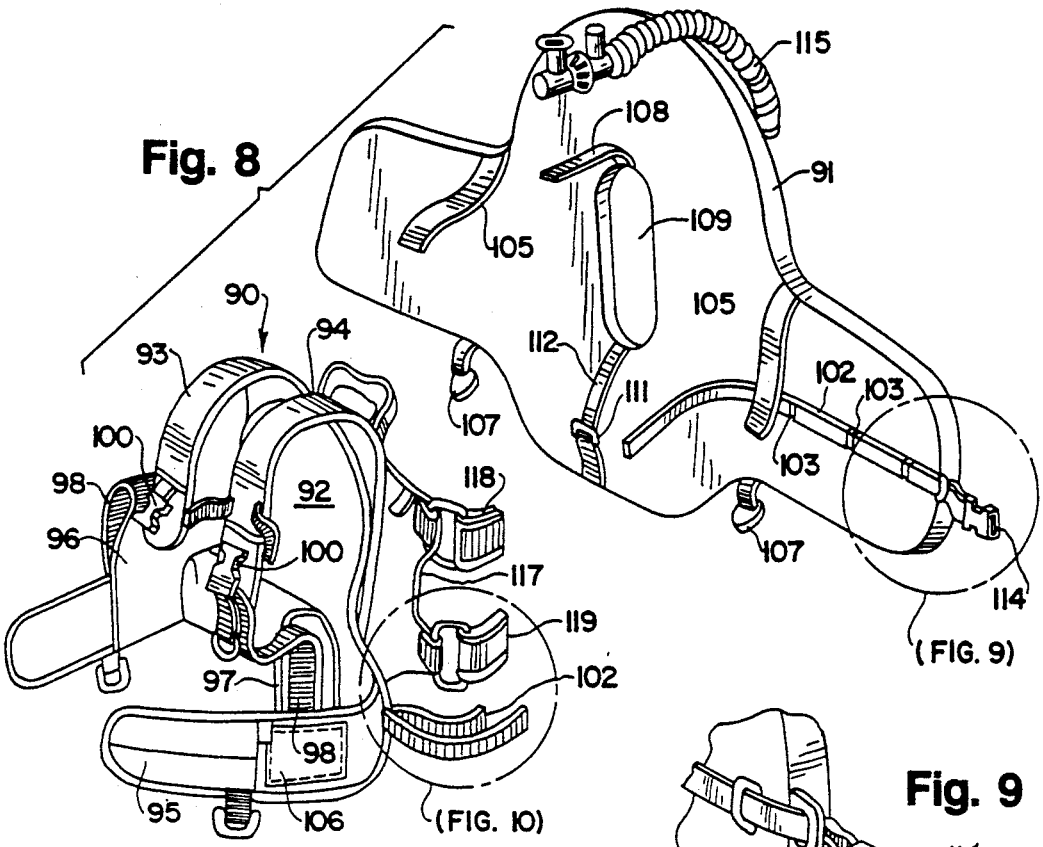
FIG. 8 is an exploded perspective view of another backpack assembly and an air cell.
Figure 9:
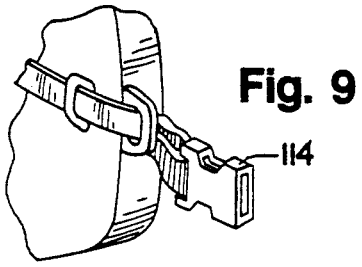
FIG. 9 is an enlarged view of one of the buckles on the air cell.
Figure 10:
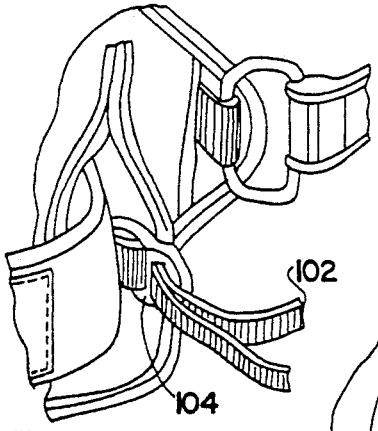
FIGS. 10–12 are enlarged views which illustrate the attachment of the air cell to the backpack assembly.
Figure 12:
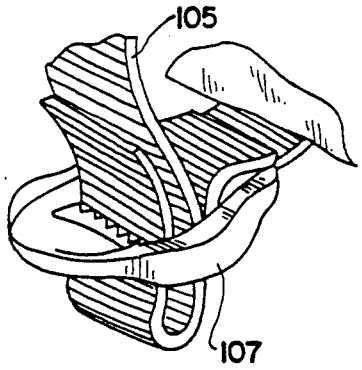
Figure 11:
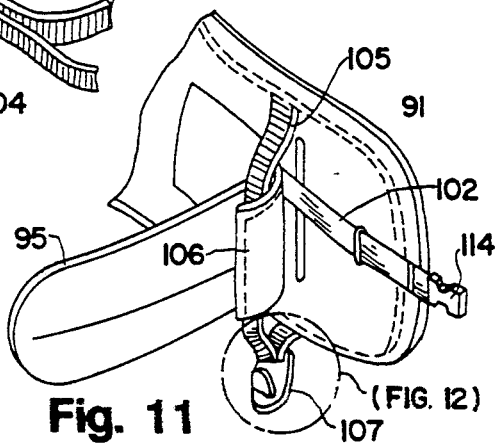

The hard backpack assembly 126 can be used without an air cell if buoyancy compensation is not required. If buoyancy compensation is desired, an inflatable air cell of the type illustrated in FIGS. 4, 5, or 8 is connected to the hard backpack assembly 126 by inserting the tank attaching strap 147 through the central opening of the air cell so that the air cell is clamped between the air tank and the backpack frame.

While in the foregoing specification a detailed description of specific embodiments of the invention was set for the purpose of illustration, it will be understood that many of the details herein given may be varied considerably by those skilled in the art without departing from the spirit and scope of the invention.

What is claimed is:

1. A buoyancy compensator assembly comprising a backpack assembly and a separately formed inflatable air cell which is removably attached to the backpack assembly, the backpack assembly including:

a) means for supporting a tank of compressed gas;

b) a cummerbund adapted to surround the waist of a wearer;

c) a shoulder harness comprising a pair of shoulder straps adapted to extend over the shoulders of a wearer; and d) means for connecting the shoulder straps to the cummerbund, the backpack assembly and the air cell including means for removably attaching the air cell to the backpack assembly whereby the backpack assembly can be used with or without the air cell for supporting a tank of compressed gas on a wearer, the air cell including a back portion and a pair of side portions, the back portion being provided with an opening through which the tank-supporting means of the backpack assembly extends when the air cell is attached to the backpack assembly, the air cell including a lower portion which extends below the side portions of the air cell and is adapted to overlie the lower back and a portion of the buttocks of a wearer.

2. The buoyancy compensator assembly of claim 1 in which the side portions of the air cell extend along side the cummerbund and are removably attached to the cummerbund.

3. The buoyancy compensator assembly of claim 1 in which said tank supporting means includes a rigid frame, said cummerbund and shoulder harness being attached to the frame.

4. A backpack assembly for supporting a tank of compressed gas comprising:

a) a back portion which is adapted to overlie the back of a wearer;

b) a cummerbund attached to the back portion which is adapted to surround the waist of a wearer;

c) a pair of shoulder straps attached to the back portion which are adapted to extend over the shoulders of a wearer;

d) means for connecting each of the shoulder straps to the cummerbund;

e) a tank supporting portion having upper and lower portions, the lower portion of the tank supporting portion being attached to a lower portion of the back portion, f) means on the tank supporting portion for holding a tank of compressed gas, and g) hook and loop fasteners on the upper portion of the tank supporting portion and an upper portion of the back portion for releasably attaching said upper portions.

5. The backpack assembly of claim 4 in which said back portion includes a fabric sheet and a pad inside the fabric shell for cushioning the weight of the tank.

6. The backpack assembly of claim 5 including a relatively rigid but flexible panel inside of said fabric shell between the pad and the tank supporting portion.

7. The backpack assembly of claim 4 in which said means for connecting the shoulder straps to the cummerbund include a pair of auxiliary support panels which are attached to portions of the cummerbund which are adapted to be positioned on the sides of a wearer and which extend upwardly and forwardly from the cummerbund, and attaching means on the auxiliary support panels for attaching the auxiliary support panels to the shoulder straps.

8. A backpack assembly for supporting a tank of compressed gas comprising:

a) a back portion which is adapted to overlie the back of a wearer;

b) a cummerbund attached to the back portion which is adapted to surround the waist of a wearer;

c) a pair of shoulder straps attached to the back portion which are adapted to extend over the shoulders of a wearer;

d) means for connecting each of the shoulder straps to the cummerbund, including a pair of auxiliary support panels which are attached to portions of the cummerbund;

e) a tank supporting portion having upper and lower portions, the lower portion of the tank supporting portion being attached to a lower portion of the back portion, f) means on the tank supporting portion for holding a tank of compressed gas, and g) a support strap attached to the cummerbund and to each auxiliary support panel adjacent the attaching means.

9. A backpack assembly for supporting a tank of compressed gas comprising:

a) a back portion which is adapted to overlie the back of a wearer;

b) a cummerbund attached to the back portion which is adapted to surround the waist of a wearer;

c) a pair of shoulder straps attached to the back portion which are adapted to extend over the shoulders of a wearer;

d) means for connecting each of the shoulder straps to the cummerbund, including a pair of auxiliary support panels which are attached to portions of the cummerbund;

e) a tank supporting portion having upper and lower portions, the lower portion of the tank supporting portion being attached to a lower portion of the back portion, f) means on the tank supporting portion for holding a tank of compressed gas, and g) each of the auxiliary support panels being generally V-shaped and including a rearwardly extending lower portion which is attached to the cummerbund and a forwardly extending upper portion.

10. The backpack assembly of claim 9 including a first support strap which extends in the direction of the upper portion of each auxiliary support panel and which is secured to the cummerbund, a second support strap which extends in the direction of the lower portion of each auxiliary support panel and which is secured to the cummerbund, and means for connecting the first and second support straps to the upper portion of the auxiliary support panel adjacent the attaching means.

11. The backpack assembly of claim 10 in which said connecting means includes a ring which is attached to the first and second support straps and an attaching strap which is attached to the ring and to the auxiliary support panel.

12. A buoyancy compensator assembly comprising a hard backpack assembly for supporting a tank of compressed gas and a separately formed inflatable air cell which is removably attached to the backpack assembly, the backpack assembly comprising:

a) a rigid backpack frame which is adapted to overlie the back of a wearer;

b) a cummerbund attached to the backpack frame which is adapted to surround the waist of a wearer;

c) a pair of shoulder straps attached to the backpack frame which are adapted to extend over the shoulder of a wearer;

d) means for connecting each of the shoulder straps to the cummerbund; and e) means on the backpack frame for securing a tank of compressed gas, the backpack assembly and the air cell including means for removably attaching the air cell to the backpack assembly whereby the backpack assembly can be used with or without the air cell for supporting a tank of compressed gas on a wearer, the air cell including a back portion and a pair of side portions, the back portion being provided with an opening through which the tank-supporting means on the backpack assembly extends when the air cell is attached to the backpack assembly, the air cell including a lower portion which extends below the side portions of the air cell and is adapted to overlie the lower back and a portion of the buttocks of a wearer.

* * * * *

UNITED STATES PATENT AND TRADEMARK OFFICE

CERTIFICATE OF CORRECTION

PATENT NO. : 5,249,890

DATED : October 5, 1993

INVENTOR(S) : Neil R. Bergstrom

It is certified that error appears in the above-identified patent and that said Letters Patent is hereby corrected as shown below:

Col. 7, line 23 change "sheet" to --shell--.

Signed and Sealed this

Twelfth Day of April, 1994

*Attest:*

Bruce Lehman

BRUCE LEHMAN

*Attesting Officer*

*Commissioner of Patents and Trademarks*